US006185391B1

(12) United States Patent
Tanioka

(10) Patent No.: US 6,185,391 B1
(45) Date of Patent: Feb. 6, 2001

(54) IMAGE FORMING APPARATUS HAVING MECHANISM FOR SCRAPING AWAY DETERIORATED LAYER OF TRANSFER ROLLER

(75) Inventor: Yoshiyasu Tanioka, Kashiwazaki (JP)

(73) Assignee: NEC Corporation, Tokyo (JP)

( * ) Notice: Under 35 U.S.C. 154(b), the term of this patent shall be extended for 0 days.

(21) Appl. No.: 09/488,384

(22) Filed: Jan. 20, 2000

(30) Foreign Application Priority Data

Jan. 25, 1999 (JP) ..... 11-015870

(51) Int. Cl.[7] ..... G03G 15/16

(52) U.S. Cl. ..... 399/101; 399/302; 399/308; 399/357

(58) Field of Search ..... 399/98, 99, 101, 399/302, 308, 343, 348, 357, 358, 360; 15/256.51, 256.52

(56) References Cited

U.S. PATENT DOCUMENTS 5,742,873 * 4/1998 Kubo et al. ..... 399/98

FOREIGN PATENT DOCUMENTS 6-222688 8/1994 (JP) .

7-209894 8/1995 (JP) .

* cited by examiner

*Primary Examiner*—Arthur T. Grimley
*Assistant Examiner*—Hoan Tran
(74) *Attorney, Agent, or Firm*—Ostrolenk, Faber, Gerb & Soffen, LLP

(57) ABSTRACT

An image forming apparatus having a mechanism for removing a deteriorated layer of the transfer roller is disclosed, by which the critical surface tension of the transfer roller can be suitably maintained. The apparatus includes primary transfer roller, a fixing roller, a backup roller, a belt-like photosensitive body, an isolating plate, a first cleaning roller, a polishing roller, a second cleaning roller, a brush roller, and a cleaner case. The toner image on the belt-like photosensitive body is transferred to the primary transfer roller according to the rotation of the backup roller. The toner image is then pressed and fixed by the fixing roller, and the image is further transferred to a paper which is moved and output. A deteriorated layer of the transfer roller is scraped away by the polishing roller, and remaining polishing dust is removed by the second cleaning roller. Additionally, polishing dust remaining on the polishing roller is removed by the brush roller. Accordingly, suitable critical surface tension of the primary transfer roller can be maintained.

23 Claims, 1 Drawing Sheet

IMAGE FORMING APPARATUS HAVING MECHANISM FOR SCRAPING AWAY DETERIORATED LAYER OF TRANSFER ROLLER

BACKGROUND OF THE INVENTION

1. Field of the Invention

The present invention relates to an image forming apparatus, in particular, one employing an indirect transfer method.

This application is based on Patent Application No. Hei 11-15870 filed in Japan, the contents of which are incorporated herein by reference.

2. Description of the Related Art

In the transfer and fixing section of conventional image forming apparatuses, it has been difficult to select a material suitable for the surface layer of the primary or first transfer roller because ozone deterioration of a silicone roller may occur, or a portion of the roller where no cross-linking process was performed may gradually run off.

More specifically, the transfer of a toner image is performed using the difference between the critical surface tension values of the surface layer of the belt-like photosensitive body and the surface layer of the primary transfer roller. Therefore, it is necessary that the critical surface tension of the surface of the primary transfer roller is always higher than that of the belt-like photosensitive body. Simultaneously, in order to easily detach the paper subjected to a secondary transfer and fixing process, it is necessary to keep the adhesive power between the surface of the primary transfer roller and the toner image lower than the adhesive power between the paper and the toner image. Therefore, the upper limit of the critical surface tension of the surface of the primary transfer roller must be strictly defined. It has been difficult to satisfy such a requirement by selecting a suitable material.

SUMMARY OF THE INVENTION

In consideration of the above circumstances, an object of the present invention is to provide an image forming apparatus having a mechanism for scraping away a deteriorated layer of the transfer roller by using a polishing roller and a cleaning roller.

Therefore, the present invention provides an image forming apparatus comprising:

- a belt-like photosensitive body;
- a backup roller which contacts the belt-like photosensitive body and moves the belt-like photosensitive body according to the rotation of the backup roller;
- a transfer roller for transferring a toner image formed on the belt-like photosensitive body moved by the backup roller;
- a fixing roller for further transferring and fixing the toner image, which was transferred by the transfer roller, to a paper;
- an isolating plate for detaching the paper, on which the toner image was fixed by the fixing roller, from the fixing roller;
- a first cleaning roller for absorbing and removing a toner element remaining on the transfer roller;
- a polishing roller for scraping away a deteriorated layer on the surface of the transfer roller;
- a second cleaning roller for removing polishing dust remaining on the surface of the transfer roller which was polished by the polishing roller;

- a brush roller for brushing off polishing dust remaining on the surface of the polishing roller; and
- a cleaner case for containing the polishing dust removed by the first and second cleaning rollers.

Typically, the surface layers of the primary transfer roller and the belt-like photosensitive body have different critical surface tension values by controlling the cross-linking temperature.

The transfer roller may have a metallic core on which a silicone rubber is deposited by using the injection molding method or the extruding method, and the surface of the transfer roller may be polished after a thermal cross-linking process.

Preferably, the silicone rubber is a high temperature cross-linking (HTV) type subjected to a hydrophobic process.

The base of the fixing roller may be a metallic hollow cylinder, and a surface layer having low surface tension, formed using polytetrafluoroethylene (PTFE), tetrafluoroethylene-perfluoroalkylvinylether copolymer (PFA), or a mixture of the PTFE and PFA, may be deposited on the surface of the fixing roller.

The base of the isolating plate may be metal or heat resistant plastic, and a surface layer having low surface tension, formed using polytetrafluoroethylene (PTFE), tetrafluoroethylene-perfluoroalkylvinylether copolymer (PFA), or a mixture of the PTFE and PFA, may be deposited on the surface of the isolating plate.

The base of the first cleaning roller may be a metallic hollow cylinder on which an adhesive layer using an acrylic adhesive is formed, or which is coated using a toner material.

The polishing roller may be formed using a grindstone for a metallic material, or may be made of porous ceramics.

The base of the second cleaning roller may be a metallic hollow cylinder on which an adhesive layer using an acrylic adhesive is formed, or which is coated using a toner material.

The brush roller may be made by spirally winding a resin fiber around a metallic or resin shaft.

According to the present invention, a mechanism for scraping away a deteriorated layer of a primary transfer roller is provided, so that the deteriorated layer can be removed. Therefore, a suitable critical surface tension of the surface of the primary transfer roller, necessary for the primary and secondary transfer processes, can be maintained.

In addition, another cleaning roller is provided, which works after the polishing process; thus, the efficiency for removing the ink element remaining on the surface of the primary transfer roller can be improved.

DESCRIPTION OF THE PREFERRED EMBODIMENTS

Figure 1:
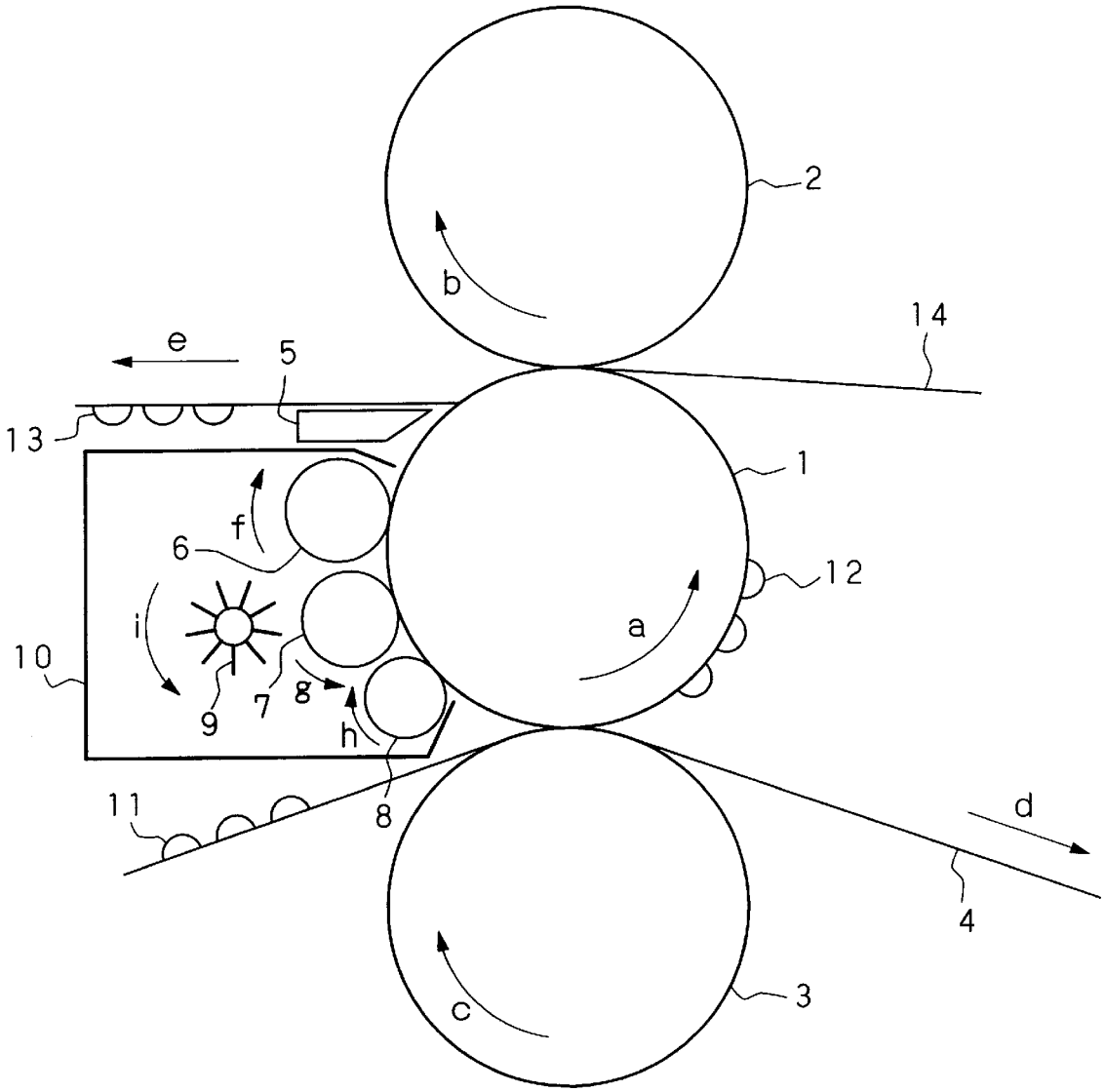
FIG. 1 is a cross-sectional view showing the transfer and fixing section of the image forming apparatus as an embodiment according to the present invention.

Hereinafter, an embodiment of the image forming apparatus according to the present invention will be explained in detail with reference to the drawings.

FIG. 1 is a cross-sectional view showing the image forming apparatus of the embodiment.

As shown in the figure, the transfer and fixing section of this image forming apparatus mainly comprises primary transfer roller 1, fixing roller 2, backup roller 3, belt-like photosensitive body 4, isolating plate 5, first cleaning roller 6, polishing roller 7, second cleaning roller 8, brush roller 9, and cleaner case 10.

The primary transfer roller 1 is formed by depositing a silicone rubber on a metallic core by using the injection molding method or the extruding method, and by polishing the surface after a thermal cross-linking process. Preferably, the silicone rubber used here is a high temperature cross-linking (HTV) type subjected to a hydrophobic process.

The base of the fixing roller 2 is a metallic hollow cylinder, and a surface layer having low surface tension, formed using polytetrafluoroethylene (PTFE) or tetrafluoroethylene-perfluoroalkylvinylether copolymer (PFA), or a mixture of the PTFE and the PFA, is deposited on the surface of the fixing roller 2. A heat source (not shown) is provided inside the fixing roller 2, and when the roller 2 is rotated in the direction indicated by arrow b, toner image 12 formed on the transfer roller 1 is pressed on and thermally fixed to paper 14.

The backup roller 3 is made of a metallic material, and is rotated in the direction indicated by arrow c so as to move the belt-like photosensitive body 4 in the direction indicated by arrow d. It is possible to provide a rubber layer on the surface of the backup roller 3.

The base of the belt-like photosensitive body 4 is a high polymer film, and a photosensitive layer is deposited on the film. A high polymer coat with low surface tension is further formed on the uppermost part. More specifically, polyethyleneterephtalate (PET), polyethylenenaphthalate (PEN), polyimide (PI), or the like may be used as the base of the belt-like photosensitive body 4. The high polymer coat with low surface tension is formed by the room or low temperature cross-linking silicone coating. If the base is made of polyimide (PI), the high polymer coat with low surface tension may be formed by the low temperature cross-linking silicone coating.

The base of the isolating plate 5 is metal or heat resistant plastic, and a surface layer having low surface tension, formed using polytetrafluoroethylene (PTFE) or tetrafluoroethylene-perfluoroalkylvinylether copolymer (PFA), or a mixture of the PTFE and the PFA, is deposited on the surface of the isolating plate 5.

The first cleaning roller 6 is rotated in the direction indicated by arrow f, so as to absorb and remove the toner which remains on the primary transfer roller 1. The base of the first cleaning roller 6 is a metallic hollow cylinder on which an adhesive layer using an acrylic adhesive is formed. A toner material may be applied to the base instead of the adhesive layer.

The polishing roller 7 is rotated in the same direction (see arrow g) as the primary transfer roller 1 (see arrow a), so as to scrape away a deteriorated layer of the primary transfer roller 1. This polishing roller 7 may be formed using a grindstone for a metallic material, or made of porous ceramics.

The second cleaning roller 8 is rotated in the direction indicated by arrow h, so as to remove polishing dust generated after the deteriorated layer of the primary transfer roller 1 is scraped away (i.e., dust generated by the polishing process). As for the first cleaning roller 6, the base of the second cleaning roller 8 is also a metallic hollow cylinder on which an adhesive layer using an acrylic adhesive is formed. A toner material may be applied to the base instead of the adhesive layer.

The brush roller 9 is rotated in the direction indicated by arrow i, so as to remove polishing dust adhering to the polishing roller 7. This brush roller 9 is made by spirally winding a resin fiber around a metallic or resin shaft.

The cleaner case 10 is a component provided for containing the polishing dust and for a dustproof object, and is made of a resin or a metallic material.

Below, an example of the operation of the image forming apparatus of the present embodiment will be explained with reference to FIG. 1

First, toner image 11 is formed on the belt-like photosensitive body 4. This toner image 11 is developed by a developing process which is not shown. The toner is in a liquid state generated by scattering the ink element using a liquid. The toner image 11, formed by the toner on the belt-like photosensitive body 4 via the developing process and a dry process (not shown), includes a liquid as well as a solid element.

As the belt-like photosensitive body 4 is rotated in the direction indicated by arrow d, toner image 11 is carried to the tangential line between backup roller 3 and the primary transfer roller 1. A load is applied to the contact portion between the backup roller 3 and the primary transfer roller 1 so as to generate a nip at the tangential line. In addition, the primary transfer roller 1 is heated by an internal heat source (not shown) so as to make the roller 1 have a fixed temperature. The pressing of toner image 11 is performed by the above nip.

As explained above, the surface layers of the primary transfer roller 1 and the belt-like photosensitive body 4 have different critical surface tension values by controlling the cross-linking temperature. Accordingly, the toner image 11 is transferred to the surface of the primary transfer roller 1 having higher critical surface tension. In this process, the liquid element included in the toner image 11 evaporates. Here, the primary transfer roller 1 is rotated in the direction indicated by arrow a by frictionally following the movement of the belt-like photosensitive body 4.

Next, the toner image 12 on the primary transfer roller 1 is carried via the rotation of the primary transfer roller 1 to the tangential line between the fixing roller 2 and the primary transfer roller 1. A load is applied to the contact portion between the primary transfer roller 1 and the fixing roller 2 so as to generate a nip at the tangential line. The paper 14 is transferred in the direction indicated by arrow e by using the nip with a suitable timing obtained by a control system (not shown).

The paper 14, which receives (remaining) heat generated by the thermal conduction and heat radiation from the primary transfer roller 1 and the fixing roller 2 and is dried, has a condition suitable for the transfer and fixing. The toner image 12 is transferred and fixed to the surface of paper 14 by the nip so that image 13 is generated. The paper 14 after the transfer and fixing process is detached by using the isolating plate 5, and is output. The remaining toner on the primary transfer roller 1, which was not transferred to paper 14 in the above-explained transfer and fixing process, is absorbed by the cleaning roller 6 and is removed.

By repeating the above set of processes for each printing, the surface of the primary transfer roller 1 is gradually deteriorated or degraded. This deterioration is generated by ozone oxidation during the process of charging or electrifying the surface (not shown) of the belt-like photosensitive body 4. In particular, such deterioration is generated when an organic solvent is used as a liquid because a portion of the silicone rubber, which is formed on the surface layer of the primary transfer roller 1 and which is not subjected to the cross-linking process, tends to run off. Therefore, the relevant surface layer should be mechanically scraped away.

The polishing roller 7 is pressed against the primary transfer roller 1, and is rotated in the direction indicated by arrow g by a driving force (not shown), so as to scrape away a deteriorated layer of the surface of the primary transfer roller 1. The cleaning roller 8 is pressed against the primary transfer roller I and follows the movement of the roller 1, that is, the roller 8 is rotated in the direction indicated by arrow h so as to remove polishing dust which remains on the surface of the primary transfer roller I after the polishing process.

The brush roller 9 is rotated in the direction indicated by arrow i by a driving force (not shown), so that the ends of the brush fibers brush off the polishing dust remaining on the surface of the polishing roller 7. The cleaner case 10 is provided for containing the polishing dust and for the dustproof object, and is made of a resin or metallic material.

The above-explained embodiment is a preferable embodiment according to the present invention, but any modification is possible within the spirit and scope of the claimed invention. For example, in the above embodiment of the present invention, the first and second cleaning rollers 6 and 8 are made of the same material; however, these rollers may be made of different materials in a variation.

In addition, the brush roller 9 is rotated in the above embodiment; however, the brush roller 9 may be fixed because the primary transfer roller 1 is rotated.

What is claimed is:

1. An image forming apparatus comprising:

a belt-like photosensitive body;

a backup roller which contacts the belt-like photosensitive body and moves the belt-like photosensitive body according to the rotation of the backup roller;

a transfer roller for transferring a toner image formed on the belt-like photosensitive body moved by the backup roller;

a fixing roller for further transferring and fixing the toner image, which was transferred by the transfer roller, to a paper;

an isolating plate for detaching the paper, on which the toner image was fixed by the fixing roller, from the fixing roller;

a first cleaning roller for absorbing and removing a toner element remaining on the transfer roller;

a polishing roller for scraping away a deteriorated layer on the surface of the transfer roller;

a second cleaning roller for removing polishing dust remaining on the surface of the transfer roller which was polished by the polishing roller;

a brush roller for brushing off polishing dust remaining on the surface of the polishing roller; and a cleaner case for containing the polishing dust removed by the first and second cleaning rollers.

2. An image forming apparatus as claimed in claim 1, wherein the surface layers of the transfer roller and the belt-like photosensitive body have different critical surface tension values by controlling the cross-linking temperature.

3. An image forming apparatus as claimed in claim 1, wherein the transfer roller has a metallic core on which a silicone rubber is deposited by using the injection molding method, and the surface of the transfer roller is polished after a thermal cross-linking process.

4. An image forming apparatus as claimed in claim 1, wherein the transfer roller has a metallic core on which a silicone rubber is deposited by using the extruding method, and the surface of the transfer roller is polished after a thermal cross-linking process.

5. An image forming apparatus as claimed in claim 3, wherein the silicone rubber is a high temperature cross-linking (HTV) type subjected to a hydrophobic process.

6. An image forming apparatus as claimed in claim 4, wherein the silicone rubber is a high temperature cross-linking (HTV) type subjected to a hydrophobic process.

7. An image forming apparatus as claimed in claim 1, wherein the base of the fixing roller is a metallic hollow cylinder, and a surface layer having low surface tension, formed using polytetrafluoroethylene (PTFE), is deposited on the surface of the fixing roller.

8. An image forming apparatus as claimed in claim 1, wherein the base of the fixing roller is a metallic hollow cylinder, and a surface layer having low surface tension, formed using tetrafluoroethylene-perfluoroalkylvinylether copolymer (PFA), is deposited on the surface of the fixing roller.

9. An image forming apparatus as claimed in claim 1, wherein the base of the fixing roller is a metallic hollow cylinder, and a surface layer having low surface tension, formed using a mixture of polytetrafluoroethylene (PTFE) and tetrafluoroethylene-perfluoroalkylvinylether copolymer (PFA), is deposited on the surface of the fixing roller.

10. An image forming apparatus as claimed in claim 1, wherein the base of the isolating plate is metal, and a surface layer having low surface tension, formed using polytetrafluoroethylene (PTFE), is deposited on the surface of the isolating plate.

11. An image forming apparatus as claimed in claim 1, wherein the base of the isolating plate is metal, and a surface layer having low surface tension, formed using tetrafluoroethylene-perfluoroalkylvinylether copolymer (PFA), is deposited on the surface of the isolating plate.

12. An image forming apparatus as claimed in claim 1, wherein the base of the isolating plate is metal, and a surface layer having low surface tension, formed using a mixture of polytetrafluoroethylene (PTFE) and tetrafluoroethylene-perfluoroalkylvinylether copolymer (PFA), is deposited on the surface of the isolating plate.

13. An image forming apparatus as claimed in claim 1, wherein the base of the isolating plate is heat resistant plastic, and a surface layer having low surface tension, formed using polytetrafluoroethylene (PTFE), is deposited on the surface of the isolating plate.

14. An image forming apparatus as claimed in claim 1, wherein the base of the isolating plate is heat resistant plastic, and a surface layer having low surface tension, formed using tetrafluoroethylene-perfluoroalkylvinylether copolymer (PFA), is deposited on the surface of the isolating plate.

15. An image forming apparatus as claimed in claim 1, wherein the base of the isolating plate is heat resistant plastic, and a surface layer having low surface tension, formed using a mixture of polytetrafluoroethylene (PTFE) and tetrafluoroethylene-perfluoroalkylvinylether copolymer (PFA), is deposited on the surface of the isolating plate.

16. An image forming apparatus as claimed in claim 1, wherein the base of the first cleaning roller is a metallic hollow cylinder on which an adhesive layer using an acrylic adhesive is formed.

17. An image forming apparatus as claimed in claim 1, wherein the base of the first cleaning roller is a metallic hollow cylinder which is coated using a toner material.

18. An image forming apparatus as claimed in claim 1, wherein the polishing roller is formed using a grindstone for a metallic material.

19. An image forming apparatus as claimed in claim 1, wherein the polishing roller is made of porous ceramics.

20. An image forming apparatus as claimed in claim 1, wherein the base of the second cleaning roller is a metallic hollow cylinder on which an adhesive layer using an acrylic adhesive is formed.

21. An image forming apparatus as claimed in claim 1, wherein the base of the second cleaning roller is a metallic hollow cylinder which is coated using a toner material.

22. An image forming apparatus as claimed in claim 1, wherein the brush roller is made by spirally winding a resin fiber around a metallic shaft.

23. An image forming apparatus as claimed in claim 1, wherein the brush roller is made by spirally winding a resin fiber around a resin shaft.

* * * * *